United States Patent [19]

Gulliver

[11] Patent Number: 5,058,803

[45] Date of Patent: Oct. 22, 1991

[54] CARTON WITH OVER CENTER TOGGLE ACTION INDICATING TAB

[75] Inventor: Richard F. Gulliver, Tuscaloosa, Ala.

[73] Assignee: Gulf States Paper Corporation, Tuscaloosa, Ala.

[21] Appl. No.: 634,713

[22] Filed: Dec. 27, 1990

[51] Int. Cl.[5] ..... B65D 5/08

[52] U.S. Cl. ..... 229/148; 229/120; 220/308

[58] Field of Search ..... 229/148, DIG. 14, 120, 229/40; 220/308, 309

[56] References Cited

U.S. PATENT DOCUMENTS

| | | | |
|---|---|---|---|
| 3,111,223 | 11/1963 | Jacobi | 229/40 |
| 3,205,603 | 9/1965 | Brumley | 206/459 |
| 3,396,898 | 8/1968 | Dorfmann | 229/148 |
| 3,756,497 | 9/1973 | Steward | 229/148 |
| 4,472,896 | 9/1984 | Brauner et al. | 229/148 |
| 4,630,733 | 12/1986 | Fear | 206/459 |
| 4,684,023 | 8/1987 | Cortopassi | 229/902 |
| 4,877,178 | 10/1989 | Eisman | 229/125.28 |
| 4,930,681 | 6/1990 | Fultz et al. | 229/146 |
| 4,951,865 | 8/1990 | Eisman | 229/146 |

*Primary Examiner*—Stephen Marcus
*Assistant Examiner*—Christopher McDonald
*Attorney, Agent, or Firm*—Cushman, Darby & Cushman

[57] ABSTRACT

A carton comprising a cover structure formed from a cut and scored flat blank of carton material. The cover structure includes a top wall having a plurality of side walls extending therefrom along a straight common fold line therebetween within a plane defining an interior included angle with the top wall of less than 180°. The cover structure includes a plurality of over center toggle action tabs having indicia operatively associated with each tab. Each over center toggle action tab is defined by cuts and edge lines formed in the top and side walls so as to contain a predetermined length of the common fold line therebetween which divides the tab into two tab sections. The cuts enable the peripheral edge portion of the tab defined thereby to move toward and away from the adjacent cut top and side walls while the peripheral edge portions of the tab defined by said edge lines hinge with respect to the adjacent top and side walls. Each over center toggle action tab is self-retained in a normal position wherein the two tab sections are coplanar with the top and side walls and are movable by inward digital pressure into a self-retained deflected position wherein the interior included angle between the two tab sections is greater than 180°.

19 Claims, 2 Drawing Sheets

Fig. 3.
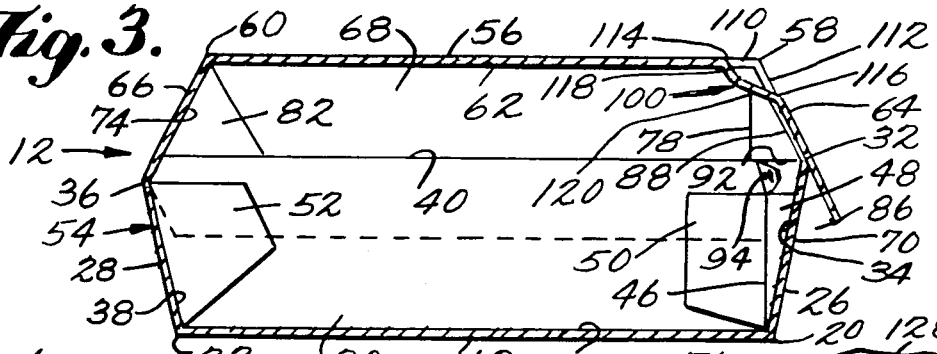
Fig. 7.
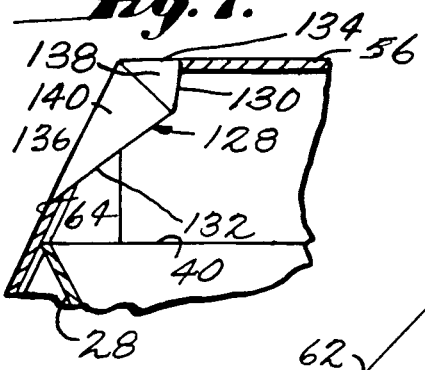
Fig. 6.
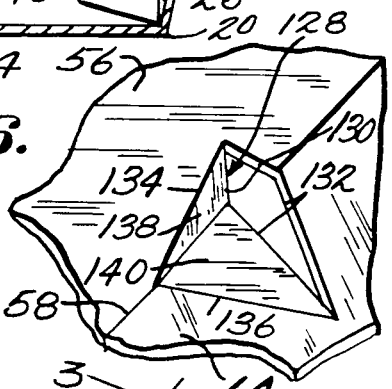
Fig. 2.
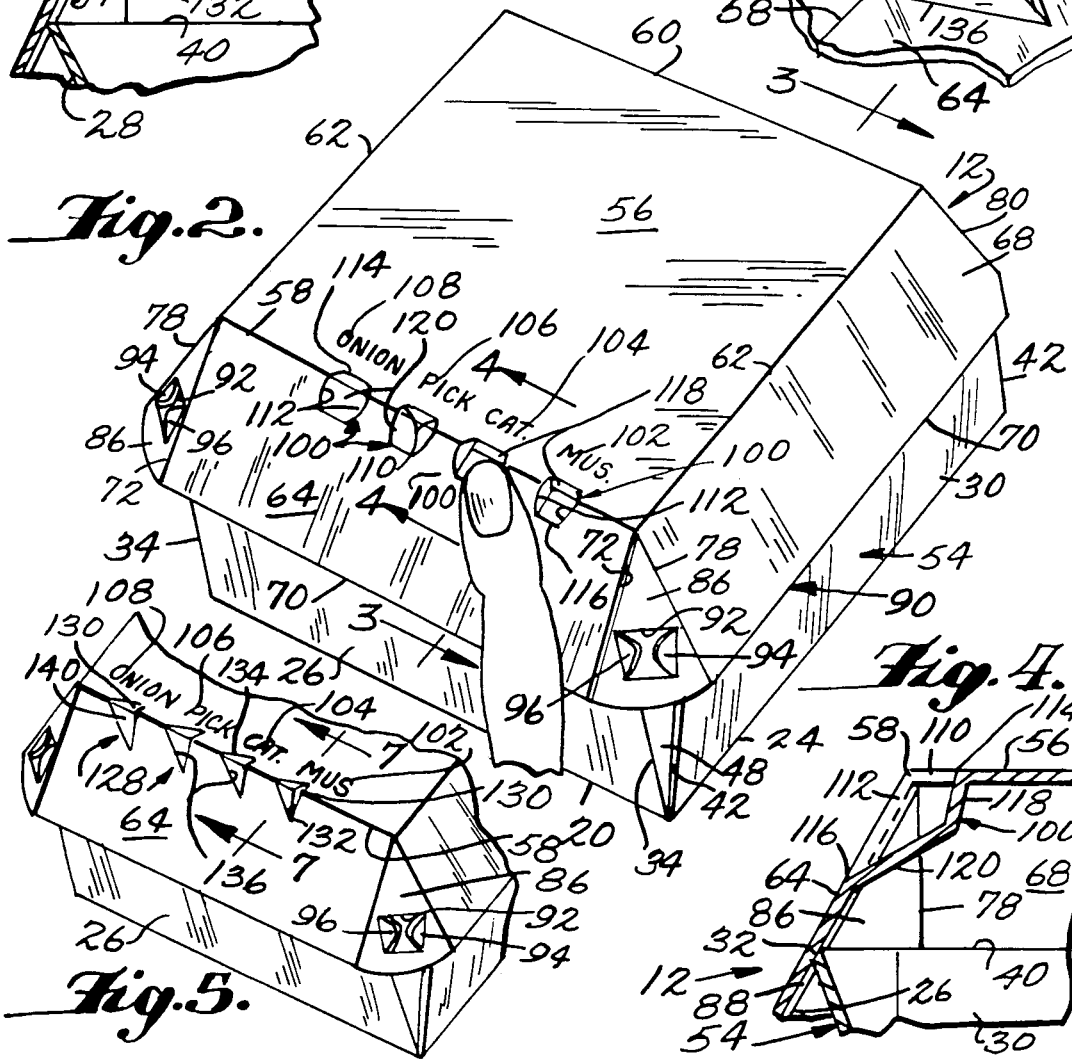
Fig. 5.
Fig. 4.

CARTON WITH OVER CENTER TOGGLE ACTION INDICATING TAB

This invention relates to sheet material products and more particularly to improvements in such sheet material products relating to exterior designation or vent holes.

Paperboard and plastic sheets have been used to make hamburger cartons and other sandwich packages. In many such uses, it is desirable to be able to designate on the exterior of the carton, the specific characteristics of the product contained therein, especially where the product may take any one of several different forms. An example of such designations is in hamburger cartons where the contained hamburger may be made with various different spreads and additives. A typical method of designation has been to provide a number of designated boxes, such as ☐ pickles, ☐ onions, ☐ relish, ☐ mustard, ☐ catsup, ☐ mayo, ☐ sauce which are then specifically identified either by adding marks or in some instances removing punch-out tabs.

A problem with this mode of identification is that once made, it cannot be easily unmade without seriously marking the container. Punch-outs have also been used to provide an optional vent hole for cartons containing food or other products which can become soggy or otherwise disadvantageous unless vented to atmosphere. Here again, once a vent hole has been provided, it cannot be easily undone. There is still a need to provide a cost effective optional indicator or vent hole provider which can be easily undesignated or returned to a closed position.

An object of the present invention is to fulfill the above-described need. In accordance with the principles of the present invention, this objective is obtained by providing in a sheet material structure having two wall portions integrally interconnected by a common fold line and disposed so as to extend from said common fold line in angular relation with respect to one another to thereby define an interior included angle therebetween of less than 180° an improvement which comprises delineations defining the peripheral edges of an over center toggle action tab which extends into the two wall portions and contains a predetermined length of the common fold line which serves to divide the tab into two tab sections. The delineations include cuts and edge lines formed in the wall portions enabling the peripheral edge portion of the tab defined by the cuts to move toward and away from the adjacent cut wall portions while the peripheral edge portions of the tab defined by the edge lines hinge with respect to the adjacent wall portions. The over center toggle action tab is self-retained in a normal position wherein the two tab sections are coplanar with the two wall portions so as to define an interior included angle therebetween which is the same as the interior included angle between the two wall portions and is movable from the normal position by inward digital pressure on the predetermined length of the common fold line into a self-retained deflected position wherein the interior included angle between the two tab sections is greater than 180°.

Preferably, one of the tab sections is of a lesser size than the other such that the one tab section is relatively rigid and the other tab section is relatively flexible whereby during the movement thereof between the normal and deflected positions the other relatively flexible tab section is flexed by the relatively rigid one tab section.

Another object of the present invention is the provision of a carton comprising a cover structure formed from a cut and scored flat blank of carton material. The cover structure includes a top wall having a periphery defined by a series of straight edges and a plurality of side walls folded from a plurality of the straight edges of said top wall. Each side wall extends from the top wall along an associated top wall straight edge constituting a common fold line therebetween within a plane defining an interior included angle with the top wall of less than 180°. The cover structure includes delineations defining a plurality of over center toggle action tabs, each of which extends within the top wall and an interconnected side wall and contains a predetermined length of the common fold line therebetween which serves to divide the tab into two tab sections. Indicia is provided on the carton material in operative association with each tab so as to give a visual indication distinctive thereto indicative of a distinctive product received in the erected carton. The delineations defining each over center toggle action tab including cuts and edge lines formed in the top and side walls enabling the peripheral edge portion of the tab defined by the cuts to move toward and away from the adjacent cut top and side walls while the peripheral edge portions of the tab defined by said edge lines hinge with respect to the adjacent top and side walls. Each over center toggle action tab is self-retained in a normal position wherein the two tab sections are coplanar with the top and side walls so as to define an interior included angle therebetween which is the same as the interior included angle between the top and side walls and being movable from the normal position by inward digital pressure on the predetermined length of the common fold line therebetween into a self-retained deflected position wherein the interior included angle between the two tab sections is greater than 180°.

Another object of the present invention is the provision of a flat carton blank for forming the carton cover structure which is simple in construction easy to erect and effective in operation.

These and other objects of the present invention will become more apparent during the course of the following detailed description and appended claims.

The invention may best be understood with reference to the accompanying drawings wherein an illustrative embodiment is shown.

IN THE DRAWINGS

FIG. 2 is a perspective view of a carton erected from the blank shown in FIG. 1;

FIG. 3 is a sectional view taken along the line 3—3 of FIG. 2;

FIG. 4 is an enlarged fragmentary sectional view taken along the line 4—4 of FIG. 2;

FIG. 5 is a fragmentary perspective view similar to FIG. 1 showing another form of the present invention;

FIG. 6 is a fragmentary perspective view of a snap-action tab embodied in the carton shown in FIG. 5; and FIG. 7 is an enlarged fragmentary sectional view taken along the line 7—7 of FIG. 5.

Figure 1:
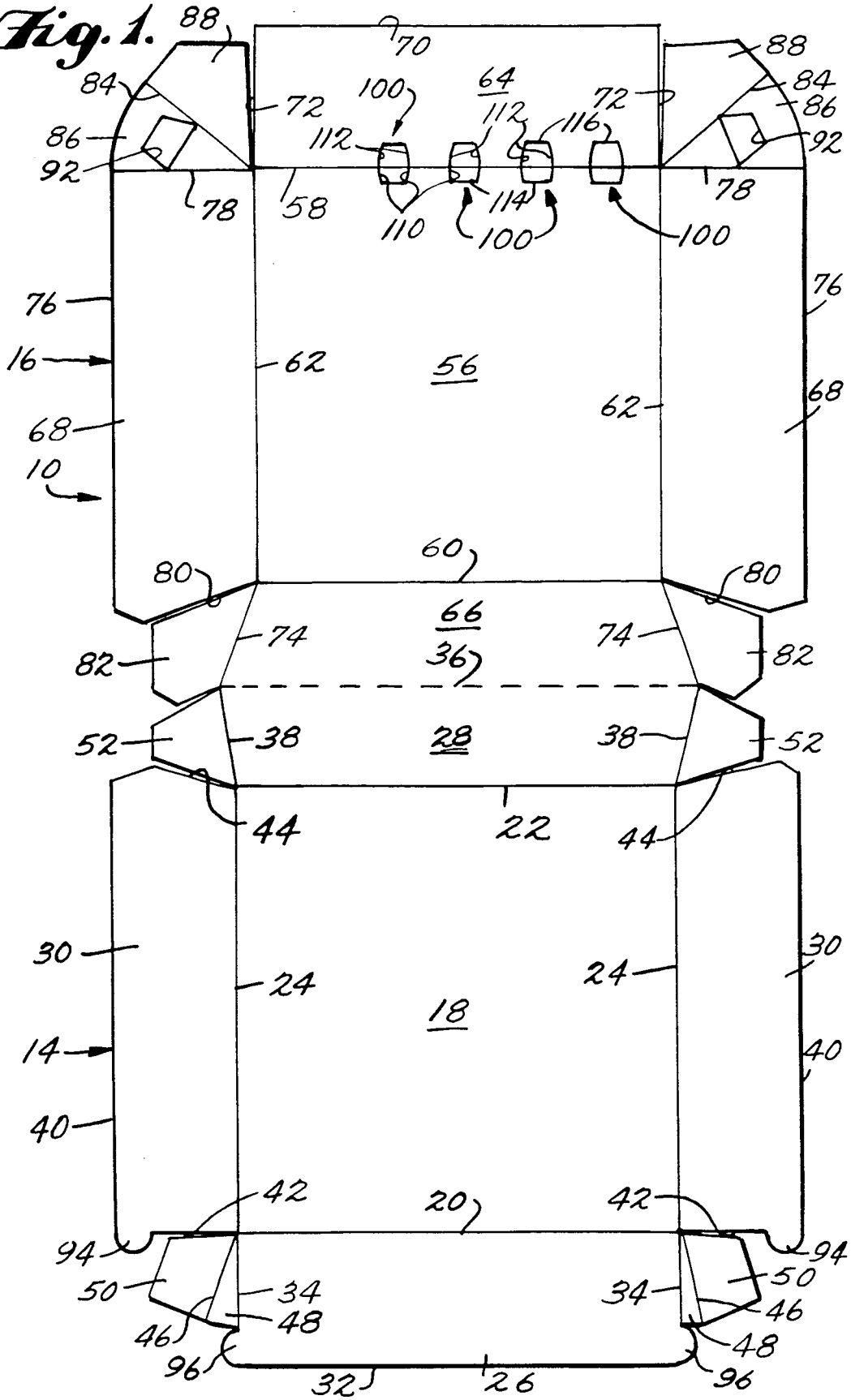
FIG. 1 is a top plan view of a cut and scored flat blank of carton material embodying the principles of the present invention.

Referring now more particularly to the drawings, there is shown in FIG. 1 thereof one form of a one-piece flat blank of carton material, generally indicated at 10, embodying the principles of the present invention, which is operable to be erected and retained by adhesive into an easy close - easy open carton, generally indicated at 12, shown in FIGS. 2–5, which also embodies the principles of the present invention. The present invention is particularly concerned with the provision of structure built into the carton which serves the purpose of venting the interior thereof and/or indicating the specific nature of the contents of the carton 12. The invention also contemplates the provision of structure to provide these functions in other related devices made of sheet material having two angularly related panels. The construction of the carton 12 itself is exemplary only. More specifically, the carton is of the easy-close easy-open type such as disclosed in commonly assigned U. S. patent application No. 07/625181 filed Dec. 10, 1990, entitled "Closable Carton with Improved Snap Action Lock", the disclosure of which is hereby incorporated by reference into the present specification.

As disclosed in the aforesaid application, the flat blank 10 includes a tray section, generally indicated at 14, and a cover section, generally indicated at 16, the two sections being hingedly connected together. The tray section 14 includes a bottom wall 18 which is defined peripherally by a plurality of straight edges, including a front edge 20, a rearward edge 22, and left and right edges 24. The tray section 14 also includes a plurality of side walls which are hinged to the bottom wall along the straight edges thereof including a front side wall 26, rearward side wall 28, and left and right side walls 30. As shown, the front side wall 26 is defined peripherally by an inner side edge which is common with the front edge 20 of the bottom wall 18, an outer side edge 32 which is a free edge and opposite end edges 34. Rearward side wall 28 is defined peripherally by an inner side edge which is common with the rearward edge 22 of the bottom wall 18, an outer side edge 36 and opposite end edges 38. Left and right side walls 30 are defined peripherally by inner side edges which are common with the left and right edges 24 of the bottom wall 18, outer side edges 40, forward end edges 42 and rearward end edges 44.

As shown, the opposite end edges 34 of the front side wall 26 define fold lines for integral flaps divided by diagonal fold lines 46 so as to form inner corner walls 48 and outer glue tabs 50. A second pair of flaps providing glue tabs 52 are hinged to the end edges 38 of the rear side wall 28. The four glue tabs provide means for maintaining the tray section 14 in an erected position wherein the side walls 26, 28 and 30 extend upwardly and outwardly from the bottom wall 18 so that the outer edges 32, 36 and 40 of the side walls define an open top of a tray structure, generally indicated at 54. As best shown in FIG. 3, the glue tabs 50 and 52 are suitably glued by a suitable adhesive or glue to the adjacent interior surface of the left and right side walls 30.

The cover section 16 includes a top wall 56 which is of similar configuration to the bottom wall 18, being defined peripherally by front, rearward and left and right corresponding straight edges 58, 60, and 62 respectively. In a similar manner, the cover section includes front, rearward and left and right side walls 64, 66, and 68, respectively, which are hinged to the top wall 56 along the straight edges 58, 60, and 62 respectively thereof. As before, the front side wall 64 is defined peripherally by an inner side edge defined by the front edge 58 of the top wall 56, an outer side edge 70 and a pair of opposite end edges 72 extending therebetween. The rearward side wall 66 is defined peripherally by an inner side edge common with the rear edge 60 of the top wall 56, an outer side edge common with the outer side edge 36 of the rear side wall 28 of the tray section 14 and opposite end edges 74. The left and right side walls 68 are defined peripherally by inner side edges common with the left and right edges 62 of the top wall 56, outer side edges 76, front end edges 78, and rearward end edges 80.

As shown, the end edges 74 of the rearward cover side wall 66 define fold lines for flaps providing glue tabs 82 which are hinged thereto along the fold lines. The front end edges 78 of the left and right side walls 68 are defined by straight fold lines which serve to join integral flaps having diagonal fold lines 84 therein which serve to divide the flaps into inner corner walls 86 and outer glue tabs 88.

As before, the four glue tabs 82 and 88 serve to retain the cover section 16 in an erected condition defining a cover structure, generally indicated at 90. A suitable glue or adhesive is utilized to retain the cover structure 90 in erected condition. As best shown in FIG. 3, the glue tabs 82 are suitably glued to the adjacent interior surfaces of the left and right side walls 68 and the glue tabs 88 are glued to the adjacent interior surface of the front side wall 64.

In its initial use at the fast food establishment, the erected carton 12 is held in an open position wherein the bottom wall 18 and top wall 56 are disposed generally in the same plane so that the cover structure 90 is disposed in an open position providing access to the open top of the tray structure 54. In this position, the tray side walls 26, 28, and 30 extend upwardly and outwardly from the bottom wall 18 and the cover side walls 64, 66, and 68 likewise extend upwardly and outwardly from the top wall 56. The carton 12 is thus in a condition to enter into a nested and stacked relationship with a multiplicity of similar cartons 12 in a similar open position, which is the usual relationship in which the carton is held in the fast food establishment.

The common outer side edges 36 of the rear side walls 28 and 66 provide a hinge about which the cover structure 90 can be moved from its open position into a closed position, as shown in FIGS. 2–4, wherein the front side wall 64, corner walls 86, and the left and right side walls 68 of the cover structure 90 extend downwardly and outwardly of the upper edges of the front side wall 26, corner walls 48, and left and right side walls 30 of the bottom tray structure 54.

As disclosed in the aforesaid application, means is provided in the carton blank 10 for releasably locking the cover structure 90 in its closed position with respect to the bottom tray structure 54. This means preferably includes openings 92 formed in the corner walls 86 respectively of the cover structure 90, tabs 94 defined by bulges in the outer portions of the forward end edges 42 of the left and right tray side walls 30 and tabs 96 defined by bulges in the outer portions of the opposite end edges 34 of the front side wall 26 outwardly of the inner fold lines defined thereby.

To close the carton after the tray structure has been filled with a suitable product, as, for example, fast food, such as a hamburger or the like, the cover structure 90 is simply hinged about the hinge line defined by the edge 36 until it reaches a position generally overlying the tray structure 54. In this position, it will be noted that the front side wall 64, the left and right side walls 68 and the corner walls 86 of the cover structure 90 extend downwardly and outwardly beyond the open top of the tray structure 54. It will also be noted that the corner walls 86 include interior surfaces disposed below the openings 92 which are in a position to be engaged by the tabs 94 and 96 as the cover structure 90 is pressed downwardly after the aforesaid interengagement. As the cover structure 90 is continued to be moved downwardly, either the lower portion of the corner walls deflect outwardly or the tabs 94 and 96 deflect inwardly or both after which the tabs reach a position in which they snap through the openings 92 so as to extend upwardly and outwardly through the openings. This snap action extension of the tabs 94 and 96 into the openings 92 serves to releasably lock the cover structure 90 in the closed position shown in FIG. 2, 3, and 4 with respect to the tray structure 54.

As previously indicated, the present invention is more particularly concerned with the provision of structure in the carton 12 and more particularly the cover structure 90 thereof which preferably provides the function of selectively designating the specific contents of the carton. In the preferred embodiment shown in FIGS. 1–4, the structure is in the form of a series of over center toggle action tabs, each of which is generally indicated at 100, and a series of distinctive indicia associated with each of the tabs. In the exemplary embodiment shown, there are four tabs 100 and the four distinctive indicia are mustard 102, catsup 104, pickle 106, and onion 108. In the embodiment shown, the tabs 100 are formed in the front cover side wall 64 and top cover wall 56 along the common edge 58 and the indicia is on the top cover wall 56 adjacent the tabs. It will be understood that the tabs and indicia may be positioned in other convenient locations in accordance with the principles hereinafter enunciated.

As shown, each tab 100 is defined peripherally in part by a first pair of cuts 110 spaced along the common edge 58 extending into the top cover wall 56 and by a second pair of cuts 112 extending from the edge 58 at the ends of cuts 110 thereon into the front cover side wall 64. The remaining periphery of each tab 110 is defined by a fold line 114 in the top cover wall 56 extending between the ends of the cuts 110 therein and a fold line 116 in the front cover side wall 64 extending between the ends of the cuts 112 therein. It will be noted that the portion of the common edge 58 extending between the aligned ends of the cuts 110 and 112 serves to divide the associated tab 100 into two tab portions 118 and 120. While it is within the broad aspects of the present invention to make the tab portions equal, preferably one of the tab portions, as, for example, tab portion 120, is larger than the other. This relationship is advantageous in that it materially aids in accomplishing the over center toggle action which takes place when a tab 100 is manually moved from a normal position wherein the two tab portions 118 and 120 are coplanar with the top cover wall 56 and front cover side wall 64 respectively. In this normal position, the tab portions 118 and 120, like the walls 56 and 64, define an interior included angle therebetween which is less than 180° and preferably greater than 90°, such as the angle of approximately 118° shown. The cuts 110 and 112 allow the juncture 58 of the two tab portions 118 and 120 to be manually moved inwardly by digital pressure, which pressure tends to cause the tab portions to be compressed together between the fixed fold lines 114 and 116. By making the tab portion 118 smaller and hence more longitudinally rigid than the larger more longitudinally flexible tab portion 120, a natural flexure or partial collapse of the larger tab portion 120 is induced together with a simple pivotal movement of the shorter tab portion about its fold line 114. Once the common edge 58 of the tab 100 moves past a plane passing between both fold lines 114 and 116, the tab portions tend to straighten themselves on the opposite side of the aforesaid plane into a self-retained deflected position wherein the interior included angle between the two tab portions 118 and 120 is greater than 180° such as the approximately 242° angle shown. The action is similar to the action of an over center spring-actuated toggle linkage except that, rather than the pivot points of the links moving against and under the bias of a spring, the flexing of preferably one tab portion (or both) takes place against and under the self bias of the tab portions themselves. Once a tab 100 has been moved by digital pressure from its normal position into its deflected position, the tab portions 118 and 120 are self-biased to remain in the deflected position. FIG. 2 illustrates the tab 100 associated with the mustard indicia 102 in its deflected position and tab 100 associated with the catsup indicia 104 being moved into its deflected position by digital pressure.

In the exemplary utilization of the carton 12 previously described, it can be assumed that the carton 12 is to receive fast food in the form of a hamburger. If the hamburger placed in the carton has added to it one or more of the additives indicated by the indicia 102, 104, 106, and 108, the operator simply moves the associated tab from its normal position into its deflect position. In the event that a tab is mistakenly moved, it is a simple matter for the operator to lift the cover structure 90 so as to obtain interior access to the tab and then to digitally push the tab 100 back into its normal position. Once the carton with its contents as indicated is delivered to the user at the fast food establishment, the user simply moves the cover structure 90 from its closed position into its open position by manually engaging beneath the lower edge 70 of the front cover side wall or below the lower edges of the corner walls 86 to gain access to the indicated hamburger confined in the open tray structure 54.

FIGS. 5, 6, and 7 illustrate a modified form of over center toggle-action tab, generally indicated at 128, which may be utilized in accordance with the principles of the present invention in lieu of the over center toggle-action tab 100. As shown, each tab 128 is defined peripherally in part by a cut 130 extending from the common edge 58 into the top cover wall 56 and a cut 132 extending from the edge 58 at the associated end of the cut 130 into the front cover side wall 64. The remaining periphery of each tab 128 is defined by a fold line 138 within the top cover wall 56 which extends from the end of the cut 130 therein diagonally to the common edge 58 at a position spaced from the position that the cut 130 extends therefrom and a fold line 136 within the front cover side panel 64 extending from the end of the cut 132 therein diagonally to the common edge 58 at the point the fold line 134 ends thereon. With this construction, the portion of the common edge 58 extending between the ends of the cuts 130 and 132 on the edge 58 to the ends of the fold lines 134 and 136 thereon divides the tab into two triangularly shaped tab portions 138 and 140. Again, as shown, it is preferred that these tab portions are of unequal size to facilitate the toggle action. It can be seen that the sections of the tab portions adjacent the cuts 130 and 132 act in a manner quite similar to the tab portions 118 and 120 of the tabs 100. Thus, each tab 128 is normally biased into a normal position wherein the tab portions are coplanar with the top cover wall 56 and front cover side wall 64 respectively into a deflected position wherein the interior included angle between the tab portions 138 and 140 is an angle greater than 180°. The arrangement is such that the tab portions are self-biased into the deflected position as well.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. In a sheet material structure having two wall portions integrally interconnected by a common fold line and disposed so as to extend from said common fold line in angular relation with respect to one another to thereby define an interior included angle therebetween of less than 180°, the improvement which comprises means defining the peripheral edges of an over center toggle action tab which extends into said two wall portions and contains predetermined length of said common fold line which serves to divide the tab into two tab sections, said tab edge defining means including cuts and edge lines formed in said wall portions enabling the peripheral edge portion of said tab defined by said cuts to move toward and away from the adjacent cut panel portions while the peripheral edge portion of the tab defined by said edge lines hinge with respect to the adjacent wall portions, said over center toggle action tab being self-retained in a normal position wherein said two tab sections are coplanar with said two wall portions so as to define an interior included angle therebetween which is the same as the interior included angle between said two wall portions and being movable from said normal position by inward digital pressure on the predetermined length of said common fold line into a self-retained deflected position wherein the interior included angle between the two tab sections is greater than 180°, one of said tab sections being of a lesser size than the other such that said one tab section is relatively rigid and the other tab section is relatively flexible whereby during the movement thereof between said normal and deflected positions the other relatively flexible tab section is flexed by the relatively rigid one tab section.

2. A sheet material structure as defined in claim 1 wherein said cuts include two cuts in each wall portion beginning at opposite ends of the contained length of common fold line and terminating in spaced relation with respect to said common fold line and with respect to each other, said edge lines including an edge line in each wall portion extending between the spaced terminations of the cuts in the associated wall portion.

3. A sheet material structure as defined in claim 2 wherein the cuts are straight and extend generally perpendicular to the common fold line.

4. A sheet material structure as defined in claim 3 wherein said edge lines are straight and parallel to each other.

5. A sheet material structure as defined in claim 4 wherein the included angle between said wall portions is greater than 90°.

6. A sheet material structure as defined in claim 1 wherein the cuts include a cut in each wall portion beginning at one end of the contained length of the common fold line and terminating in the associated wall portion in spaced relation thereto and said edge lines include an edge line in each wall portion extending from an opposite end of the contained length of common fold line and terminating at the termination of the cut in the associated wall portion.

7. A sheet material structure as defined in claim 6 wherein said cuts are straight and extend generally perpendicular to the common fold line.

8. A sheet material structure as defined in claim 7 wherein the fold lines are straight.

9. A sheet material structure as defined in claim 8 wherein the included angle between said wall portions is greater than 90°.

10. A carton blank comprising a flat sheet of carton material cut and scored to define a series of interconnected walls foldable to provide at least a part of an erected carton for receiving one of a series of distinctive products, said walls including a plurality of pairs of walls, each pair of which is interconnected by a common fold line so as to be folded relative to one another when erected to extend from the common fold line thereof in angular relation with respect to one another so as to define an interior included angle therebetween of less than 180°, said carton material having means defining a plurality of over center toggle action tabs, each of which extends within a pair of walls and contains a predetermined length of the common fold line therebetween which serves to divide the tab into two tab sections, indicia on said carton material operatively associated with each tab so as to give a visual indication distinctive thereto indicative of a distinctive product received in the erected carton, each over center toggle action tab defining means including cuts and edge lines formed in the associated pair of walls such than when said walls are folded to provide the erected carton part, said cuts and edge lines enable the peripheral edge portion of the tab defined by said cuts to move toward and away from the adjacent cut walls while the peripheral edge portions of the tab defined by said edge lines hinge with respect to the adjacent walls, each over center toggle action tab when said walls are folded to provide the erected carton part being self-retained in a normal position wherein the two tab sections thereof are coplanar with the associated pair of walls so as to define an interior included angle therebetween which is the same as the interior included angle between the associated pair of walls and being movable from said normal position by inward digital pressure on the predetermined length of the associated common fold line into a self-retained deflected position wherein the interior included angle between the two tab sections is greater than 180°.

11. A carton blank as defined in claim 10 wherein one of each of said two tab sections is of a lesser size than the other such that said one tab section is relatively rigid and the other tab section is relatively flexible whereby during the movement thereof between said normal and deflected positions the other relatively flexible tab section is flexed by the relatively rigid one tab section.

12. A carton blank as defined in claim 11 wherein said cuts include two cuts in each associated wall beginning at opposite ends of the contained length of common fold line and terminating in spaced relation with respect to said common fold line and with respect to each other, said edge lines including an edge line in each associated wall extending between the spaced terminations of the cuts in the associated wall.

13. A carton blank as defined in claim 12 wherein the cuts are straight and extend generally perpendicular to the common fold line.

14. A carton blank as defined in claim 13 wherein said edge lines are straight and parallel to each other.

15. A carton comprising a cover structure formed from a cut and scored flat blank of carton material, said cover structure including a top wall having a periphery defined by a series of straight edges and a plurality of side walls folded from a plurality of the straight edges of said top wall, each side wall extending from said top wall along an associated top wall straight edge constituting a common fold line therebetween within a plane defining an interior included angle with the top wall of less than 180°, said cover structure including means defining a plurality of over center toggle action tabs, each of which extends within said top wall and an interconnected side wall and contains a predetermined length of the common fold line therebetween which serves to divide the tab into two tab sections, indicia on said carton material operatively associated with each tab so as to give a visual indication distinctive thereto indicative of a distinctive product received in the erected carton, each over center toggle action tab defining means including cuts and edge lines formed in said top and side walls enabling the peripheral edge portion of the tab defined by said cuts to move toward and away from the adjacent cut top and side walls while the peripheral edge portions of the tab defined by said edge lines hinge with respect to the adjacent top and side walls, each over center toggle action tab being self-retained in a normal position wherein said two tab sections are coplanar with said top and side walls so as to define an interior included angle therebetween which is the same as the interior included angle between said top and side walls and being movable from said normal position by inward digital pressure on the predetermined length of the common fold line therebetween into a self-retained deflected position wherein the interior included angle between the two tab sections is greater than 180°.

16. A carton as defined in claim 15 wherein one of each of said two tab sections is of a lesser size than the other such that said one tab section is relatively rigid and the other tab section is relatively flexible whereby during the movement thereof between said normal and deflected positions the other relatively flexible tab section is flexed by the relatively rigid one tab section.

17. A carton as defined in claim 16 wherein said cuts include two cuts in top and side wall beginning at opposite ends of the contained length of common fold line and terminating in spaced relation with respect to said common fold line and with respect to each other, said edge lines including an edge line in each top and side wall extending between the spaced terminations of the cuts in the associated wall.

18. A carton as defined in claim 17 wherein the cuts are straight and extend generally perpendicular to the common fold line.

19. A carton as defined in claim 18 wherein said edge lines are straight and parallel to each other.

* * * * *